US007793474B2

(12) United States Patent
Tyler et al.

(10) Patent No.: US 7,793,474 B2
(45) Date of Patent: Sep. 14, 2010

(54) OVER-MOUNT CORNER

(75) Inventors: Francis S. Tyler, Westerville, OH (US); David C. Hines, Swanton, OH (US); David H. Wolf, Newark, OH (US); Joshua M. Broehl, Worthington, OH (US); Jamison J. Float, Westerville, OH (US); James H. Lua, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 44 days.

(21) Appl. No.: 12/052,111

(22) Filed: Mar. 20, 2008

(65) Prior Publication Data

US 2009/0235596 A1 Sep. 24, 2009

(51) Int. Cl.
*E04B 2/00* (2006.01)

(52) U.S. Cl. ..... 52/287.1; 52/311.1; 52/314

(58) Field of Classification Search ..... 52/287.1, 52/275, 314, 598, 608, 609, 611, 385, 315, 52/288.1, 555

See application file for complete search history.

(56) References Cited

U.S. PATENT DOCUMENTS

| | | | | | |
|---|---|---|---|---|---|
| 1,592,591 | A | | 7/1926 | Amele | |
| 1,711,026 | A | * | 4/1929 | Kline | 52/314 |
| 1,961,627 | A | * | 6/1934 | Wilber | 52/314 |
| 3,426,490 | A | | 2/1969 | Taylor | |
| 3,524,790 | A | | 8/1970 | Mason | |
| 3,621,625 | A | | 11/1971 | Medow | |
| 3,646,715 | A | | 3/1972 | Pope | |
| 3,740,910 | A | * | 6/1973 | Taylor et al. | 52/315 |
| 3,795,721 | A | | 3/1974 | Gilbert et al. | |
| 4,522,002 | A | * | 6/1985 | Davis et al. | 52/309.1 |
| 4,644,719 | A | | 2/1987 | Salazar | |
| 4,659,055 | A | | 4/1987 | Hardt | |
| 4,793,586 | A | | 12/1988 | Buss | |
| 5,232,646 | A | | 8/1993 | Nasvik et al. | |
| 5,386,963 | A | | 2/1995 | Nasvik et al. | |
| 5,473,851 | A | | 12/1995 | Northrup, Jr. | |
| 5,536,557 | A | | 7/1996 | Nasvik et al. | |
| 5,836,123 | A | * | 11/1998 | Gulino | 52/288.1 |
| 5,885,502 | A | | 3/1999 | DeAngelis et al. | |
| 6,122,878 | A | * | 9/2000 | Pliley | 52/528 |
| 6,129,329 | A | | 10/2000 | Nasvik et al. | |
| 6,631,600 | B2 | * | 10/2003 | Schiedegger et al. | 52/658 |

(Continued)

*Primary Examiner*—David Dunn
*Assistant Examiner*—Adam Barlow
(74) *Attorney, Agent, or Firm*—MacMillan, Sobanski & Todd, LLC

(57) ABSTRACT

A quoin formed of individual over-mount corner units constructed as simulated brick to match the adjoining wall panels forming the exterior cover of an exterior wall of a building is provided. The corner units are formed with a front portion configured as courses of brick separated by mortar joints joined to a rear plate that provides a support frame for the corner unit. Multiple standoffs are positioned on the rear plate opposite mortar joints formed on the front portion to provide a location for driving fasteners to mount the corner unit onto the building substructure. The overlapping nature of the corner units with respect to the wall panels allows the wall panels to be cut imprecisely at the exterior corner. The standoffs maintain a predetermined spacing between the building substructure and the rear plate to establish a channel for the drainage of moisture due to condensation or rain infiltration.

19 Claims, 8 Drawing Sheets

U.S. PATENT DOCUMENTS

| | | | | |
|---|---|---|---|---|
| 7,228,665 | B2 * | 6/2007 | Perry | 52/287.1 |
| 7,404,274 | B2 * | 7/2008 | Hayes | 52/513 |
| 2005/0210811 | A1 | 9/2005 | Nasvik | |
| 2006/0156668 | A1 | 7/2006 | Nasvik | |
| 2006/0157634 | A1 | 7/2006 | Nasvik | |
| 2008/0155938 | A1 * | 7/2008 | Attebery | 52/747.12 |

* cited by examiner

OVER-MOUNT CORNER

TECHNICAL FIELD AND INDUSTRIAL APPLICABILITY OF THE INVENTION

The present invention relates generally to simulated panels, and more particularly, to a quoin corner that mounts over simulated panels to provide an aesthetic appearance to a residential dwelling or other habitable building.

BACKGROUND OF THE INVENTION

Most habitable buildings are made of vertical support members formed from wood or metal studs. These vertical support members form a substructure on which sheets of sheathing material are attached to form the walls of the building substructure. These walls require an external covering to keep rain, snow, sunlight, and other environmental factors off of the wall substructure, particularly when the sheathing material is formed of oriented strand board (OSB) or other products that are not tolerant to being in contact with significant amounts of moisture. Another covering for the wall substructure that is often selected is a covering formed of a masonry construction, such as stucco, brick, or stone, which can be either natural or artificial.

A masonry outer layer, whether it is brick, stone, stucco, or other masonry covering, requires substantial skill to be constructed properly. In response to a need for a simplified exterior masonry covering, artificial brick and stone wall panels were developed to be applied to a building wall in a manner similar to vinyl siding. However, to make a proper fit at the exterior corners of the building and have a desirable appearance, considerable care needed to be taken to provide a precise fit of the two panels joining together to make the exterior corner of the covering material. The time required to make this proper fit for the brick or stone panels resulted in lost operating efficiency, as well as substantial material waste if the panels did not precisely fit together to provide an aesthetically pleasing appearance.

Corner structures for the outer walls of prefabricated buildings and simulated surfaces are known in the art. Such corner structures provide a pleasing appearance to the home or commercial building. Non-limiting examples of corner structures for buildings are set forth below.

U.S. Pat. No. 3,426,490 to Taylor discloses a brick veneer panel formed of individual brick veneer blocks held together by a wire mesh. The veneer blocks have the same length, width, and color of conventional bricks, but are made from a plastic material. The bricks are molded on a wire mesh lath with the veneer blocks spaced from each other and positioned in a staggered pattern simulating a course of bricks. The corners are covered with corner panels that have perpendicular surfaces. The corner units are formed of brick veneer blocks which are staggered so that alternate rows of the blocks project beyond the end of blocks of intermediate rows to form an interlocking edge for engaging the adjacent wall panel.

U.S. Pat. No. 3,740,910 to Taylor, et al. teaches brick slab facings mounted upon a backing sheet in courses. The lowermost course extends below the lower edge of the panel. Joints in alternate courses are staggered relative to each other. L-shaped pieces are mounted at the corner of the structure between the brick slabs to complete the course.

U.S. Pat. No. 4,644,719 to Salazar discloses a decorative wall panel that includes a continuous base layer and a patterned layer bonded to the surface of the base layer. The base layer is formed of a reinforced cementitious material and the patterned layer is formed of a slow cured molded mixture of Portland cement, sand, and a pigmented binder. The patterned layer may have a simulated brick appearance. Opposite ends of the panels mate and interlock with ends of similarly constructed panels. A corner section panel is adapted to form a right angle corner. The corner panel section may be an integral unit or it may be two sections that are adapted to fit together to form the corner.

U.S. Pat. No. 4,659,055 to Hardt teaches a building corner arrangement for the outer wall of homes and other buildings that are formed from prefabricated panels made from concrete or other cementitious materials. The panel end walls are angled with respect to their inner and outer surfaces at an angle that lies within the range from about 0 to about ninety degrees so that a groove or slot is formed that extends the height of the building. A mold shaped to define an inside corner and outside corner is affixed to the corner of the building. Concrete or other cementitious material is introduced into the groove until it reaches the top of the mold. Once the concrete or cementitious material is cured, the mold is removed. The result is the formation of a building corner similar to a French Provincial style home.

Although corner structures are known in the art, there remains a need in the at for a corner quoin structure that may be utilized with brick or stone wall panels, including simulated wall panels, so that the wall panels may be installed in a less precise manner. In addition, the corner quoin structure would provide an aesthetically pleasing exterior covering for the wall substructure and a functional design that permits water and condensation drainage at the exterior corners of the building.

SUMMARY OF THE INVENTION

It is an object of the present invention to provide an aesthetically pleasing corner unit for placement on an exterior of a residential or commercial building. The corner unit includes a simulated front face, standoffs, and optionally, a rear plate. The corner unit is formed to have a decorative exterior surface that can be formed to simulate substantially any masonry or other building surface. External decorative or ornate projections may also be incorporated as part of the corner units. The decorative exterior surface of the corner unit may also be formed to have any number of designs and/or orientations for the simulated surface material. In one embodiment, the front face of the corner unit is formed into simulated bricks with joints positioned between the bricks. The standoffs are positioned in alignment with the joints so that mortar can be used to cover the fastener used to hold the corner unit to the substructure of the building. The corner units permit the simulated wall panels to be imprecisely cut at the corners of the building. As a result, the over-mount corners are easily and quickly installed over the rough cut edges of the wall panels. Additionally, the corner unit is fastened directly to the substructure of a building, not through the wall panels, which permits the wall panels attached to the building substructure to move independently of the corner unit. The corner unit may be constructed from glass fiber reinforced concrete.

It is also an object of the present invention to provide an aesthetically pleasing corner for an exterior wall of a residential or commercial building. The exterior wall includes a substructure, typically a sheathing material, and a layer of simulated wall panels. A quoin formed of at least one corner unit is positioned at the corner of the building. The corner unit includes a front decorative exterior surface, a rear plate, and standoffs projecting rearwardly from the rear plate. The standoffs have a depth that is at least equal to the thickness of the wall panels so that the rear plate is positioned on top of the exterior surface of the wall panels when the corner unit is affixed to the substructure. The quoin may be composed of a plurality of individual corner units positioned in a generally vertical orientation. The appearance of the quoin is determined by the design, structure, and orientation of the individual corner units. A particular advantage relating to the use of the corner unit is that exterior panels mounted to the walls of the building do not have to be cut precisely at ninety degree angles or to a precise length. The corner unit overlaps the rough or unevenly cut ends of the simulated panels, thereby hiding the imperfect ends of the wall panels. In addition, a layer of mortar is applied between the terminus of the wall panels and the overlying corner unit along the vertical dimension of the quoin. This layer of mortar is typically located external or adjacent to the standoffs so that the central part of the corner unit will establish an open, continuous vertical channel for the drainage of water. The mortar is typically a polymer-based mortar to permit the corner unit to accommodate any angular displacement in the wall of the building. In an alternate embodiment, the quoin is formed as a single unit.

It is a further object of the present invention to provide a method of forming a decorative corner for a wall of a building. To form the decorative corner, a quoin is mounted at the corner of a residential or commercial building. The quoin is formed of at least one corner unit that has a front face with a decorative, simulated surface and a plurality of rearwardly projecting standoffs. Typically, the corner unit also includes a rear plate to provide additional stability to the corner unit. The corner unit(s) may be mounted to the corner of the wall by placing the corner unit over simulated wall panels and driving mechanical fasteners through holes in the standoffs and into the substructure of the building. The fasteners are then typically covered with mortar to conceal the fastener and provide an aesthetic appearance to the quoin. The corner units are mounted, one on top of the other, in a step-wise fashion. In at least one embodiment, alternating corner units are rotated 180 degrees prior to being positioned on the corner of the wall. By rotating or not rotating the corner units prior to their application over the simulated wall panels, numerous patterns can be achieved.

It is a further object of the present invention to provide a corner unit for placement on an exterior corner of a building having a building substructure cooperative with simulated wall panels attached to exterior walls of the building to form a cover for the exterior walls comprising (1) a front, simulated surface portion, the simulated surface portion mimicking an exterior surface of a building and providing a decorative appearance, and (2) a plurality of standoffs projecting rearwardly of the front surface portion to engage the building substructure, each of the standoffs being formed with a passageway to permit passage of a fastener to secure the corner unit directly to the building substructure.

It is yet another object of the present invention to provide a corner unit, further comprising a rear plate attached to the front, simulated surface, the plurality of standoffs projecting rearwardly of the rear plate.

It is also an object of the present invention to provide a corner unit, wherein the front simulated surface portion is formed into simulated masonry units having joints positioned between the masonry units.

It is still another object of the present invention to provide a corner unit, wherein one or more of the standoffs is located in alignment with the joints.

It is a further object of the present invention to provide a corner unit, wherein the front surface portion and the rear plate are integrally formed.

It is also an object of the present invention to provide a corner unit, further comprising a polymer-based mortar between the simulated wall panels and the rear plate.

It is yet another object of the present invention to provide a corner unit, further comprising a decorative member projecting outwardly from the front simulated surface.

It is another object of the present invention to provide an exterior wall of a building forming a corner at one end thereof with a generally orthogonally extending second exterior wall comprising (1) a building substructure including a layer of exterior sheathing material, (2) a layer of wall panels having an exterior surface simulating an exterior surface of a building and attached to the sheathing material, the wall panels having a terminus end corresponding to the corner, the terminus end being located at a distance from the corner such that the sheathing material is exposed between the terminus end and the corner, and (3) a quoin formed of at least one corner unit having a decorative exterior surface and a rear plate oriented in generally orthogonally extending faces, the rear plate including a plurality of standoffs projecting rearwardly from the rear plate to engage the exposed sheathing material between the terminus end and the corner, each of the faces having a lateral width sufficiently large to overlap corresponding terminus ends of the wall panels when attached to the exposed sheathing material.

It is also an object of the present invention to provide an exterior wall, wherein each of the standoffs are formed with a passageway to permit the passage of a fastener to connect the corner unit to the exposed sheathing material.

It is a further object of the present invention to provide an exterior wall, wherein the standoffs have a depth dimension measured rearwardly from the rear plate that is at least equal to a corresponding thickness dimension of the wall panels such that the rear plate will be positioned on top of the exterior surface of the wall panels when attached to the exposed sheathing material.

It is yet another object of the present invention to provide an exterior wall, wherein the quoin is formed from a plurality of corner units oriented in a generally vertical configuration.

It is also an object of the present invention to provide an exterior wall, wherein the plurality of corner units are arranged in an alternating reverse orientation pattern such that the alternating corner units are rotated upside down with respect to adjacent corner units.

It is another object of the present invention to provide an exterior wall, wherein the decorative exterior surface of each of the corner units is formed in a configuration defining simulated masonry units oriented in courses having joints between the masonry units.

It is a further object of the present invention to provide an exterior wall, wherein each of the corner units incorporates a plurality of courses, a first portion of the courses having more simulated bricks than a second portion of the courses.

It is yet another object of the present invention to provide a method of forming a decorative corner on an exterior wall of a building comprising mounting a quoin formed of at least one corner unit at a corner formed by two generally orthogonal external walls of a building, the at least one corner unit having a front decorative simulated surface and a rear plate, the rear plate including a plurality of standoffs projecting rearwardly from the rear plate to engage the external walls.

It is also an object of the present invention to provide a method of forming a decorative corner, further comprising mounting a plurality of wall panels to a sheathing material positioned on the external walls, each of the wall panels having a simulated exterior surface.

It is a further object of the present invention to provide a method of forming a decorative corner, wherein the mounting step includes (1) driving a fastener through the front simulated surface and through the standoff into the exposed sheathing material, and (2) covering the fastener by applying mortar to the simulated exterior surface over the fastener.

It is another object of the present invention to provide a method of forming a decorative corner, further comprising cutting the wall panels to define a terminus end of the wall panels that is located a distance from the corner with a portion of exposed sheathing material between the terminus end and the corner.

It is a further object of the present invention to provide a method of forming a decorative corner, wherein the mounting step includes attaching a plurality of corner units in a vertical configuration along the corner to form the quoin.

It is yet another object of the present invention to provide a method of forming a decorative corner, wherein the attaching step includes reversing the orientation of alternating corner units.

It is an advantage of the present invention that the over-mount corner units are quickly and easily installed.

It is another advantage of the present invention that the over-mount corner units can compensate for variations in the angle of the walls forming the exterior corner of a building or residential structure.

It is a further advantage of the present invention that the over-mount corner units overlap the wall panels at the exterior corner of the building substructure.

It is another advantage of the present invention that the wall panels do not require precise cutting to define the terminus of the wall panels near the exterior corner of the building substructure.

It is still another advantage of this invention that the standoffs are located opposite a joint between vertically spaced simulated bricks to permit the fastener head to be hidden within the corner unit.

It is yet another advantage of this invention that the fastener head can be covered with mortar for purposes of concealment.

It is a further advantage of this invention that the corner units can be inverted when mounted to the building substructure next to other corner units to vary the aesthetic appearance of the quoin created therefrom.

It is a feature of the present invention that the assembly of the over-mount corner units creates a projected quoin.

It is also a feature of the present invention that standoffs are provided on the back side of the corner units to facilitate the mounting of the corner units to the building substructure.

It is another feature of this invention that the corner units can be formed in a large variety of configurations and designs to provide different quoin configurations.

It is still another feature of this invention that the standoffs are utilized for the insertion of fasteners to mount the corner units to the building substructure.

It is yet another feature of the present invention that a corner quoin fabricated from individual corner units that overlaps the wall panels at the exterior corner of a building substructure.

The foregoing and other objects, features, and advantages of the invention will appear more fully hereinafter from a consideration of the detailed description that follows. It is to be expressly understood, however, that the drawings are for illustrative purposes and are not to be construed as defining the limits of the invention.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION AND PREFERRED EMBODIMENTS OF THE INVENTION

Figure 1:
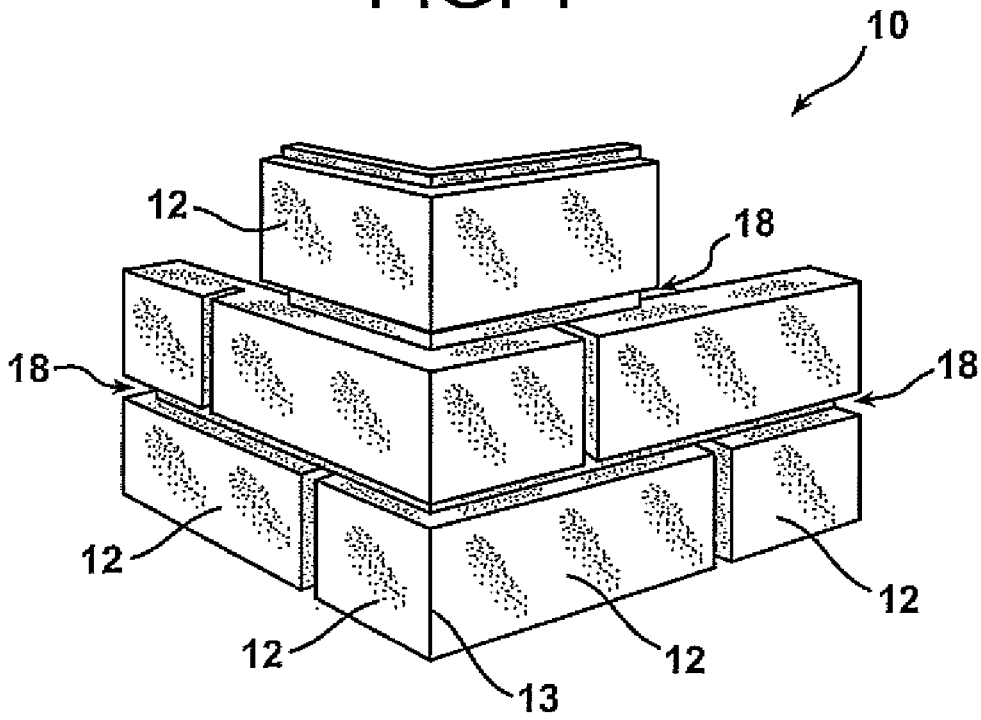
FIG. 1 is a schematic perspective illustration of the front side of an over-mount corner unit according to at least one embodiment of the present invention.

Unless defined otherwise, all technical and scientific terms used herein have the same meaning as commonly understood by one of ordinary skill in the art to which the invention belongs. All references cited herein, including published or corresponding U.S. or foreign patent applications, issued U.S. or foreign patents, or any other references, are each incorporated by reference in their entireties, including all data, tables, figures, and text presented in the cited references.

In the drawings, the thickness of the lines, layers, and regions may be exaggerated for clarity. It is to be noted that like numbers found throughout the figures denote like elements. It will be understood that when an element is referred to as being "on," another element, it can be directly on or against the other element or intervening elements may be present.

The present invention relates to projected quoin corners that mount over simulated, external panels positioned on a residential dwelling or other habitable or commercial building. The over-mount corners may be formed as distinct units that are assembled in a step-wise fashion at the corners of the building. Alternatively, the over-mount corner may be formed as a single unit that is affixed over simulated wall panels at the corners of the building. The over-mount corners are easily and quickly installed, and provide an aesthetic appearance to the building.

Referring to FIGS. 1-4, a first embodiment of the over-mount corner units can best be seen. The corner unit 10 is typically constructed from glass fiber reinforced concrete, but may alternatively be made of other fiber reinforced cementitious materials or unreinforced concrete. It is also envisioned that the corner unit may be formed of a combination of reinforced and unreinforced cementitious materials. The over-mount corner unit 10 may be formed by pouring or spraying uncured concrete into a mold to form the bricks 12, and may be formed integrally with a rear plate 14, which provides additional support and strength for the corner unit 10. In such an embodiment, no adhesive or mortar is needed to connect the bricks 12 to the rear plate 14. Alternatively, the bricks 12 and the rear plate 14 may be formed separately and affixed together with a suitable adhesive material. The concrete may be colored prior to or subsequent to molding to give the simulated brick a desired color. It is to be appreciated that the inclusion of a rear plate 14 is one embodiment of the invention; however, the corner unit 10 may be formed as a homogenous, reinforced cementitious structure without a rear plate 14.

The corner unit 10 is formed to have a decorative exterior surface that can be formed to simulate substantially any masonry or other building surface, including, but not limited to, stucco, stones, CULTURED STONE® molded stone products, marble block, wood beams, and log patterns. Additionally, external, decorative ornate projections (e.g., gargoyles, angels, 3D company logos, etc.) may be incorporated as part of the corner units 10. The decorative exterior surface may also be formed to have any number of designs and/or orientations for the simulated surface material. For instance, a simulated brick corner unit 10 may be formed to have diagonally positioned bricks 12. Alternatively, the bricks 12 may be positioned to form a parquet pattern. It is to be appreciated that the examples given herein are not exclusive and numerous patterns, designs, shapes, and surfaces can formed and utilized in the corner units 10. The ability to form distinct designs and/or patterns into simulated surface of the corner unit 10 allows the corner unit 10 to have ornate designs and patterns that are not able to be achieved with conventional bricks or other masonry surface.

FIGS. 1-4*b* illustrate a plurality of simulated bricks 12 with simulated joints 18 formed as relief spaces between the bricks 12. The simulated bricks 12 correspond to or complement the simulated brick wall panels 22, or other simulated surfaces, affixed to the walls of the building substructure 20. Additionally, the bricks 12 protrude from a rear plate 14 formed of a fiber reinforced material or metal. The rear plate 14 may extend the length and width of the rear side of the corner unit 10 or it may extend only partially along the rear side of the corner unit 10. The bricks 12 are formed into a ninety degree or substantially ninety degree corner configuration with the rear plate 14 and can be arranged in a variety of shapes and configurations, as described herein. The intersection 13 of the two orthogonally arranged faces of the corner unit 10 corresponds to the corner of the building substructure 20, while the two faces extend in a diverging manner to cover a predetermined portion of the underlying walls of the substructure 20. The wall panels 22 are terminated before reaching the corner 21 of the substructure so that the over-mount corner unit 10 will overlap the wall panels 22 and cover the ends of the wall panels 22.

Figure 2:
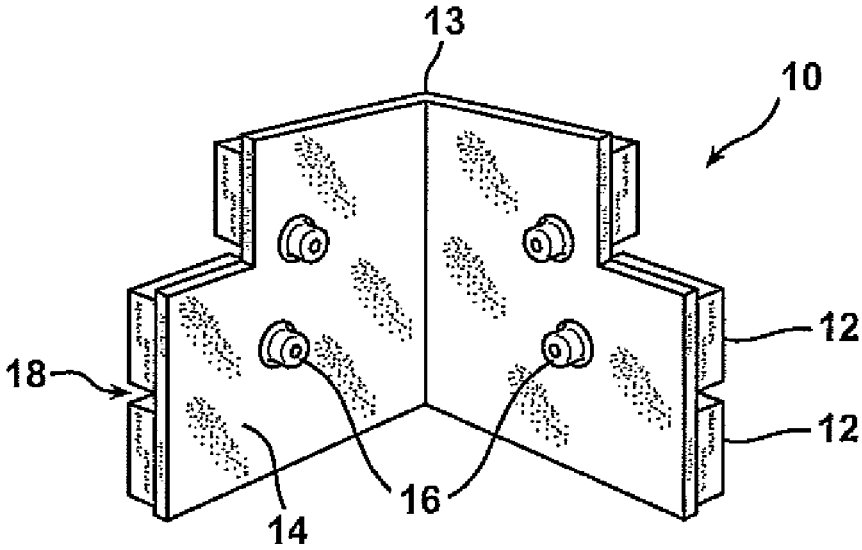
FIG. 2 is a schematic perspective illustration of the back side of an over-mount corner unit according to at least one embodiment of the present invention.
Figure 3:
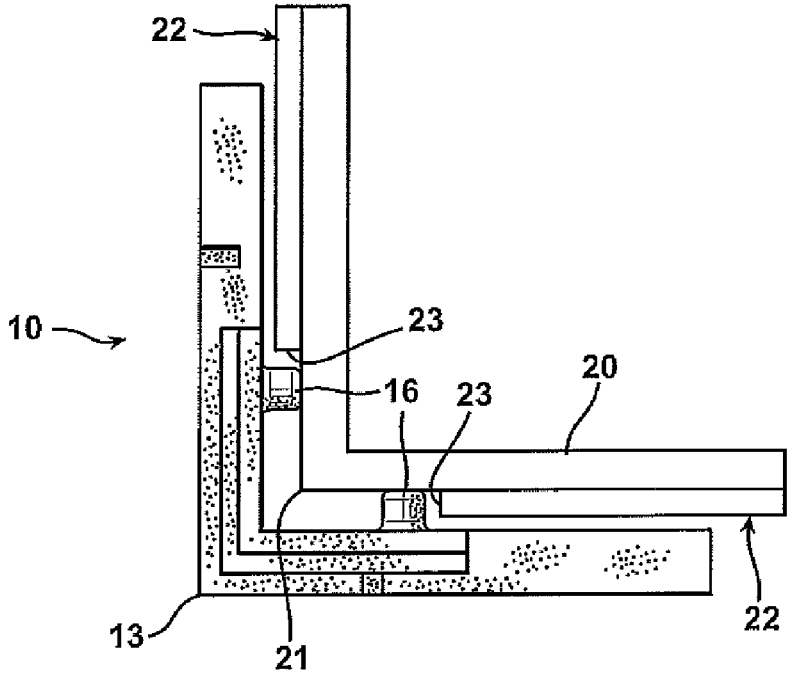
FIG. 3 is a top plan view of an over-mount corner unit placed onto a building corner defining an angular displacement of ninety degrees.

As best seen in FIG. 2, the corner unit 10 also includes standoffs 16 positioned on the rear surface of the corner unit 10. The standoffs 16 are located in alignment with the joints or spaces 18 between the simulated bricks 12 so that when mechanical fasteners (e.g., nails or screws) are utilized to affix the corner unit 10 to a substructure 20, typically oriented strand board (OSB) or plywood, of a residential dwelling or other building structure, the heads of the fasteners are located within the recessed spaces and may be concealed by mortar applied to the joints 18. For stucco and other masonry surfaces not incorporating joints, the standoffs 16 may be located in conjunction with a planned irregularity in the surface so that the addition of a layer of mortar to cover the fastener will provide a proper appearance. The standoffs 16 are formed with integral passageways (not shown) and are located such that the fastener may be driven through the standoff 16 to engage the corner studs (not shown) of the building substructure 20. In some exemplary embodiments, four standoffs 16 are utilized, although it is to be appreciated that other appropriate configurations of the standoffs 16 may be used. For example, the standoffs 16 could be formed in greater numbers to provide alternative locations to insert fasteners, formed in numbers fewer than four, or in a bar configuration, such as a vertically oriented bar (not shown) that would extend behind both spaces 18 and the simulated bricks 12.

The standoffs 16 ensure proper spacing of the corner mount 10 from the substructure so that a continuous air channel is formed between the corner unit 10 and the substructure 20 of the building, as is best seen in FIGS. 3 and 4*a*-4*c*. This spacing allows moisture to be drained from the air channel through weep holes at the base of the substructure 20 so that water created through condensation or water infiltrating the quoin structure from the atmosphere (e.g., rain or snow) can escape from the building structure. When the over-mount corner unit 10 is installed, the standoffs 16 are placed directly on the building substructure 20 between the terminus 23 of the wall panels 22 and the corner 21 of the building substructure 20 so that the diverging faces of the corner unit 10 will overlie the wall panels 22 on each respective wall of the building substructure 20 and provide a uniform appearance. Thus, the height of the standoffs 16 measured from the rear plate 14 is at least substantially equal to the overall thickness of the wall panels 22. As used herein, the term "substantially equal to" is defined as equal to or nearly equal to.

Figure 4A:
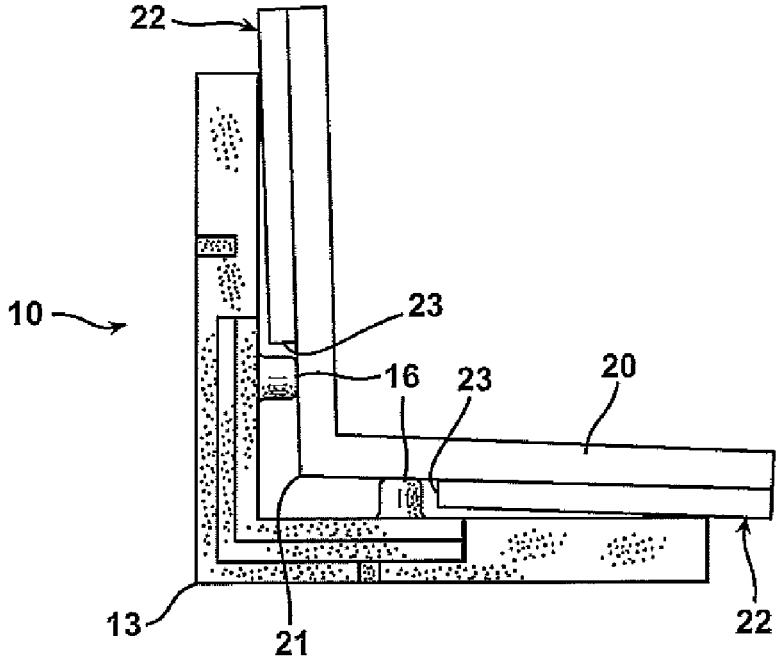
FIG. 4*a* is a top plan view of an over-mount corner unit placed onto a building corner defining an angular displacement of less than ninety degrees.
Figure 4B:
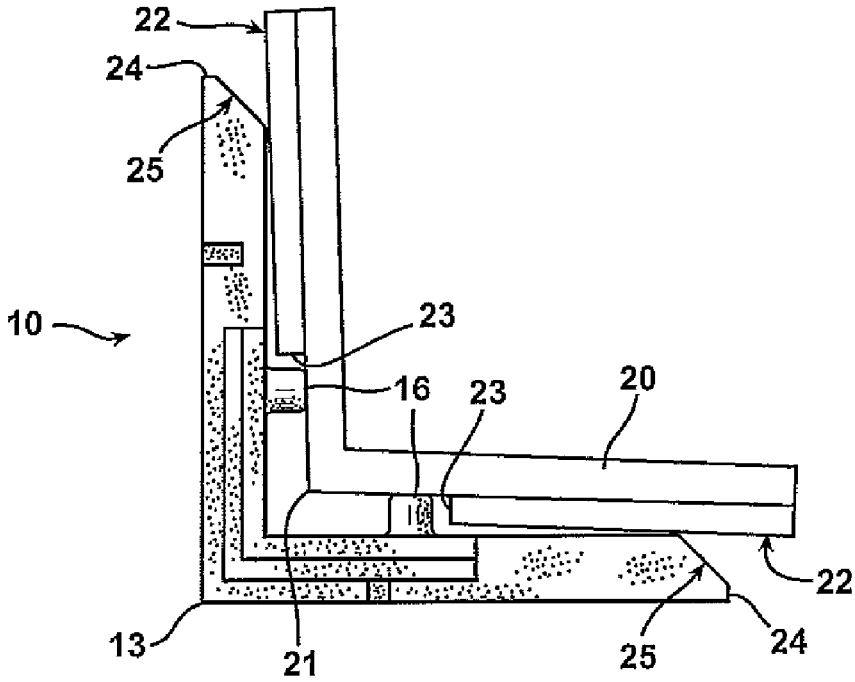
FIG. 4*b* is a top plan view of an over-mount corner unit as shown in FIG. 4*a* with chamfers incorporated in the ends of the corner unit.
Figure 4C:
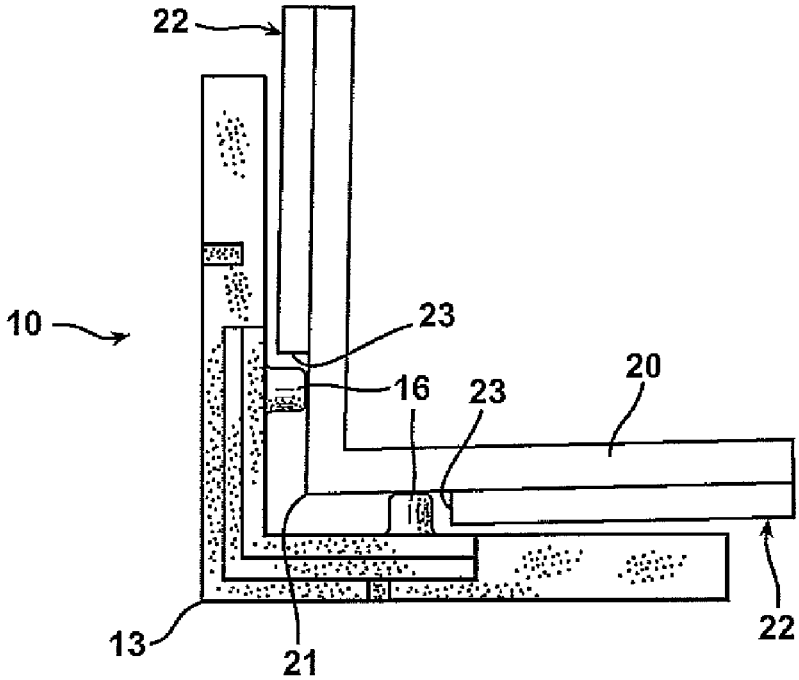
FIG. 4*c* is a top plan view of an over-mount corner unit placed onto a building corner defining an angular displacement of greater than ninety degrees.

Additionally, the standoffs 16 will conform to building substructures 20 that are formed with an angular displacement of more or less than the optimum ninety degrees, as is reflected in FIGS. 4*a* and 4*b*. The standoffs 16 position the corner unit 10 on the substructure 20 such that the rear plate 14 is spaced outwardly from the building substructure 20. By driving the fasteners through the standoffs 16 located in the simulated joints 18 between the simulated bricks 12, the fasteners force the standoffs 16 against the substructure 20 in a uniform manner. The corner unit 10 will have sufficient tolerance at the intersection 13 of the opposing faces to conform to the angular displacement of the building substructure 20 when the standoffs 16 are driven against the building substructure 20 by the fasteners connecting the corner unit 10 to the substructure 20, particularly when the error is in the range of plus or minus approximately three degrees from a ninety degree displacement. The depth of the standoff 16 and the distance from the corner unit 10 to the standoff 16 is designed so that if the substructure 20 is plus or minus about three degrees, the edges of the corner unit 10 will abut the substructure (i.e., at an angular displacement greater than 90 degrees as shown in FIG. 4*a*) or will not create an aesthetically objectionable gap between the substructure 20 and the corner unit 10 (i.e., at an angular displacement of less than ninety degrees as shown in FIG. 4*c*), Optionally, chamfers 25 may be incorporated in the ends 24 of the corner unit 10, such as is depicted in FIG. 4*b*, to provide additional bonding surfaces for the mortar when the substructure 20 has an angular displacement greater than 90 degrees. Further, the chamfers 25 provide additional clearance for the corner unit 10 where the end 24 of the corner unit 10 meets the wall 22.

The conventional use of wall panels 22 formed to simulate a masonry surface requires the wall panels 22 to be cut in a precise manner at the corners 13 of the building on which the wall panels 22 are being installed so that the wall panels 22 can be positioned in conjunction with the wall panels 22 on the mating surface forming the corner 13 to provide a proper aesthetic appearance of a masonry exterior surface. The proper positioning of these wall panels 22 and the affixing of these wall panels 22 to the building substructure 20 places a substantial amount of stress onto the building corner 13. By allowing the wall panels 22 to be rough cut to terminate short of the corner 13 of the building substructure 20, these stresses are relieved. Accordingly, the use of the corner units 10 to cover the exposed building substructure 20 between the end 23 of the wall panels 22 and the corner 13 of the substructure 20 alleviates the stresses commonly associated with the use of simulated wall panels 22.

To attach the corner unit 10 to a residential dwelling, for example, the corner unit 10 is positioned over the simulated brick panels 22 affixed to the external walls of the building substructure 20 by driving fasteners through holes located in the standoffs 16. A particular advantage relating to the use of the corner unit 10 is that the simulated brick panels 22 mounted on the walls of the building 20 do not have to be cut precisely at ninety degree angles or to a precise length, as in conventional brick laying techniques. The corner unit 10 overlaps the rough cut or unevenly cut ends 23 of the brick panels 22, thereby hiding the imperfect ends of the wall panels 22. Additionally, the corner unit 10 is fastened directly to the substructure 20 through the standoffs 16, and not to or through the brick panels 22, thereby allowing the wall panels 22 attached to the building substructure 20 to move independently of the corner unit 10. Thus, as settling or other movement of the substructure 20 occurs, the corner mount 10 is not displaced with the wall panels 22. Any suitable mechanical fastener (e.g., nails, screws) or adhesive may be utilized to affix the corner unit 10 to the substructure 20.

Figure 5:
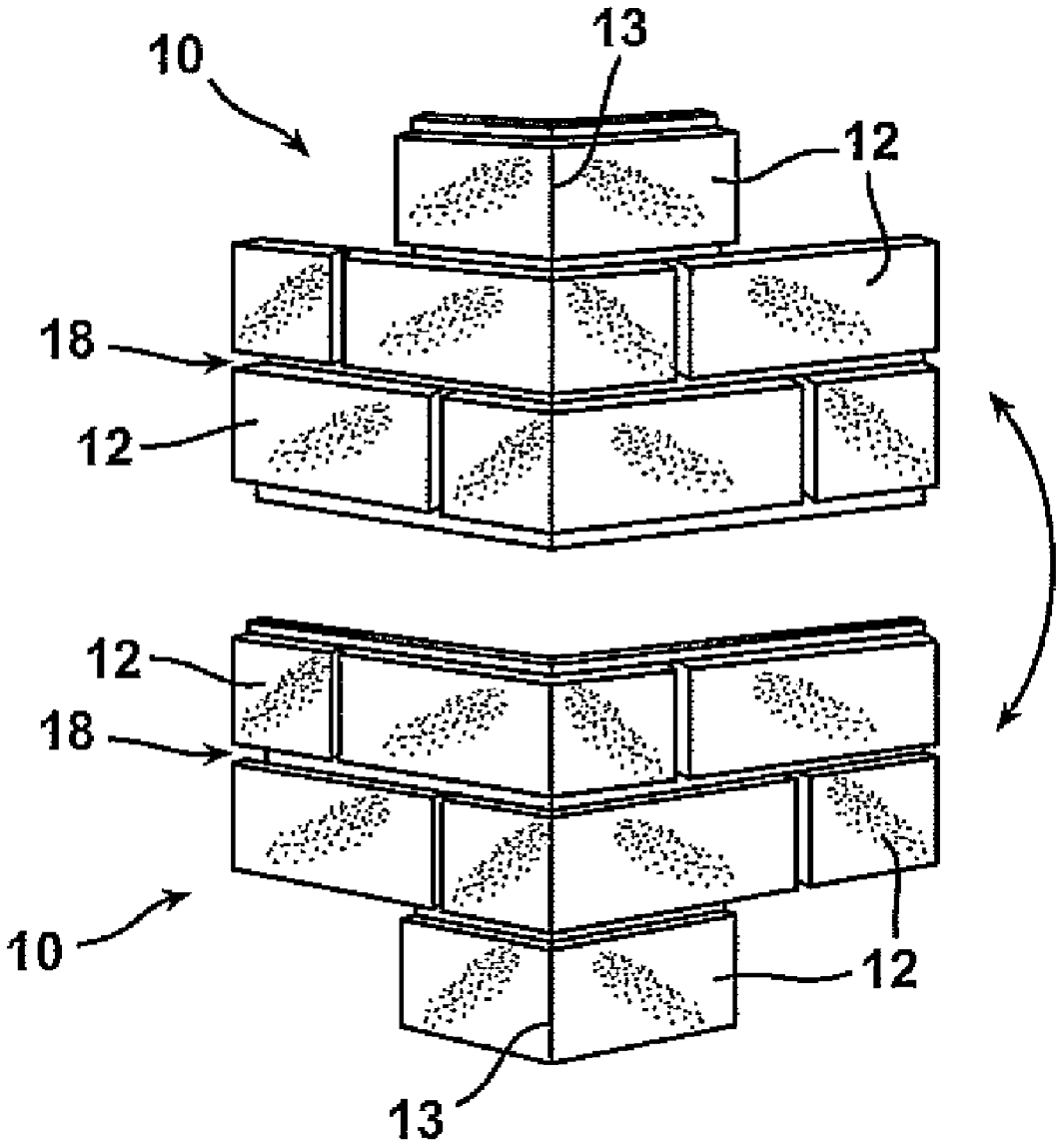
FIG. 5 is a perspective view of a pair of over-mount corner units oriented for installation on a building corner.
Figure 6:
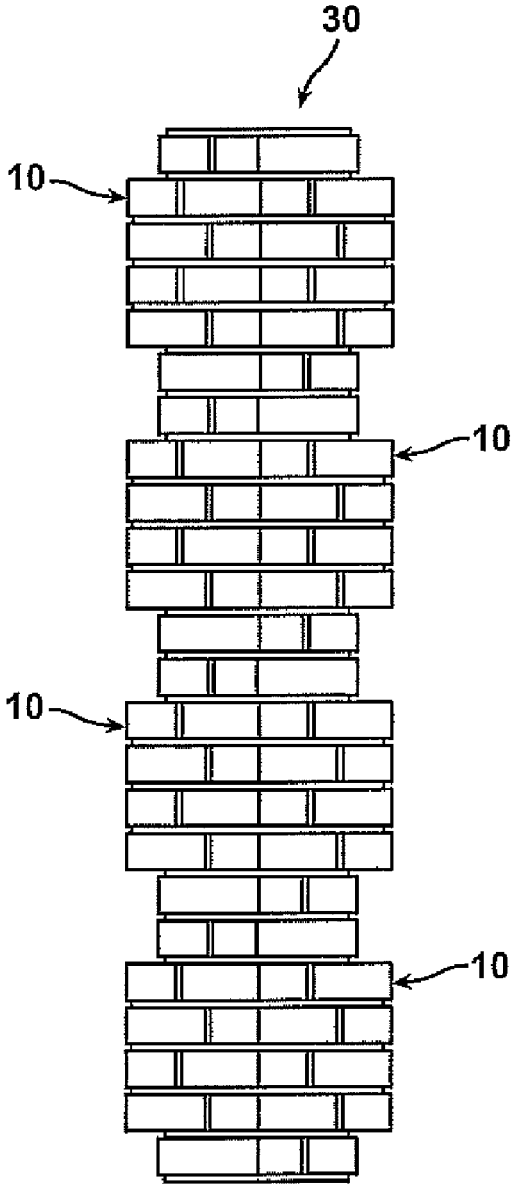
FIG. 6 is full quoin corner formed from reversing alternating over-mount corner units as reflected in FIG. 5.
Figure 7:
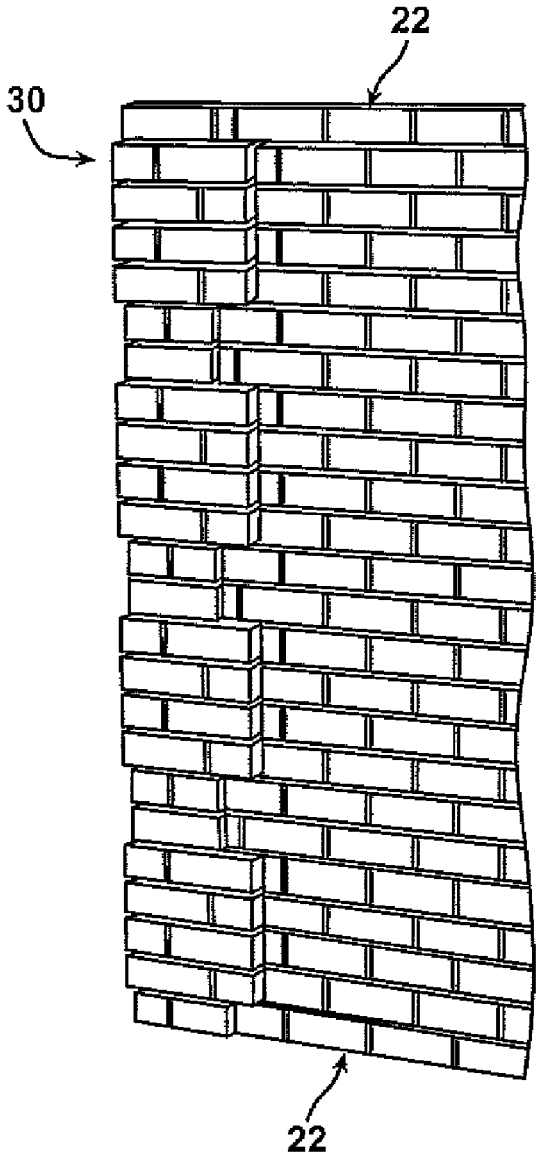
FIG. 7 is an elevational view of a portion of a building wall covered with brick panels with a full quoin corner as shown in FIG. 6 installed at the corner of the building.

Once the corner unit 10 is mounted in place, a second corner unit 20 is mounted above the first corner unit 10, as generally depicted in FIG. 5. The second corner unit 20 may or may not be identical to the first corner unit 10. Additionally, the second corner mount 15 is fastened to the substructure 20 in a desired orientation. For example, as shown in FIG. 5, the second corner unit 15 has been rotated 180 degrees before being mounted above the first corner unit 10. This rotation creates a desired pattern in the bricks 12. Additional corner units 10 are mounted above the second corner unit 15 in a similar fashion and in desired orientations to form an aesthetically pleasing quoin 30 for the building, as can be seen in FIGS. 6 and 7. It is to be appreciated that by rotating or not rotating the corner unit 10 prior to its application over the brick panels 22, numerous patterns can be achieved, and are not necessarily limited to that which is illustrated herein.

The over-mount corner units 10 can be installed after the brick panels 22 have been attached to the building substructure 20, or as the wall panels 22 are being mounted. The primary function of the corner units 10 is to allow the rapid installation of the wall panels 22 by enabling the rough cutting of the ends 23 of the wall panels 22 adjacent to the corner 13 but sufficiently short of the corner 13 that the standoffs 16 will contact the building substructure 20 when installed. The ends 23 of the wall panels 22 are located sufficiently close, however, to the corner 13 that the over-mount corner unit 10 overlaps the wall panel.

One skilled in the art will appreciate that a typical installation of the wall panels 22 and the corner units 10 will involve the placement of a layer of mortar between the terminus 23 of the wall panel 22 and the overlying back plate 14 of the corner unit along the vertical dimension of the quoin. This layer or mortar would typically be located external to the standoffs 16, or adjacent to the standoffs 16, so that the central part of the corner unit 10 will establish an open continuous vertical channel for the drainage of water. Further, the layer of mortar would establish a general seal between the corner units 10 and the building substructure 20 and/or wall panels 22 to prevent insects, dirt, and/or other debris from getting behind the quoin. The mortar may be a polymer-based (e.g., latex-based) mortar to permit the corner units to accommodate angular displacement of the substructure 20. Alternatively, caulk may be used in place of the polymer-based mortar.

Figure 8:
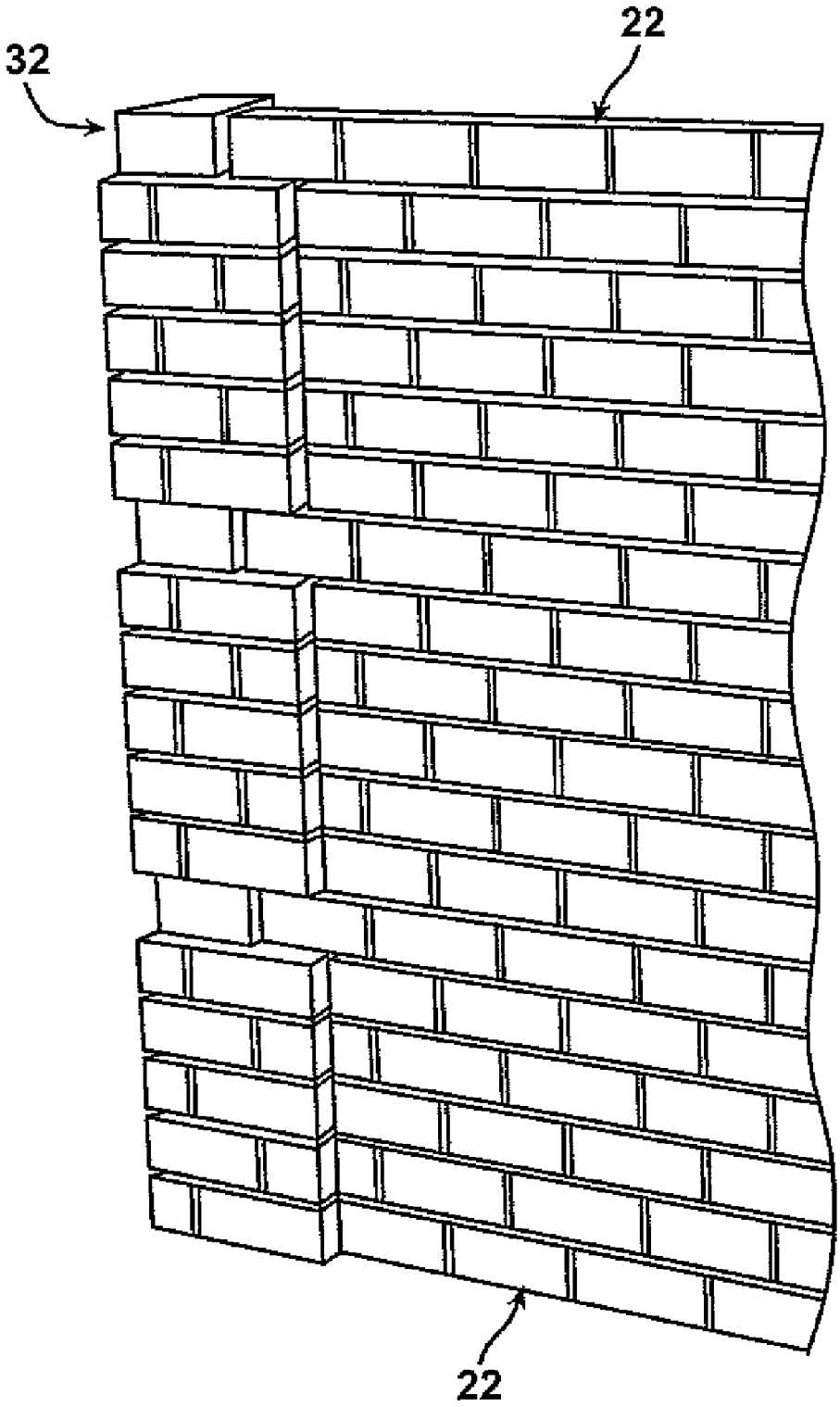
FIG. 8 is an elevational view of a portion of a building wall similar to that shown in FIG. 7, but utilizing a full quoin corner formed from over-mount corner units having a different configuration.
Figure 9:
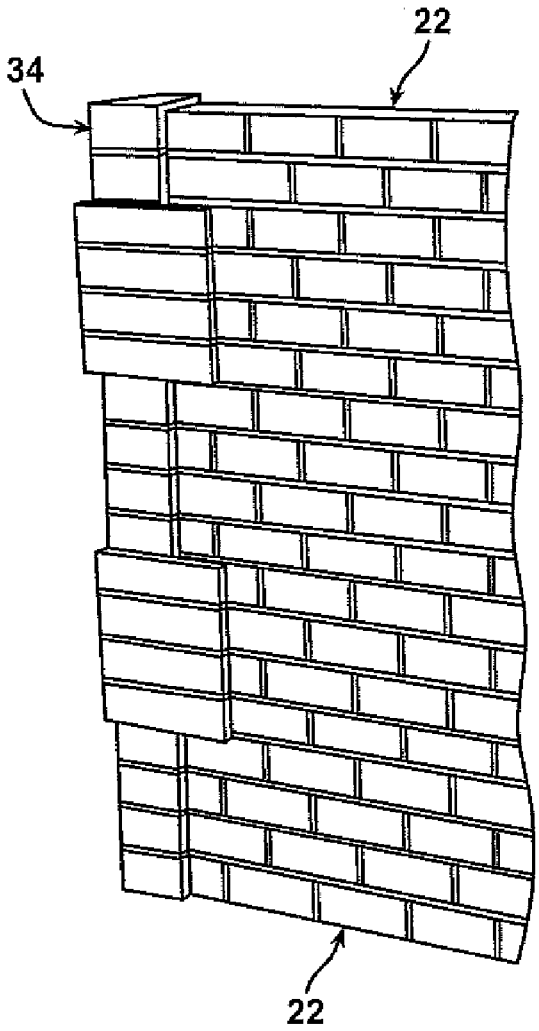
FIG. 9 is an elevational view of a portion of a building wall similar to that shown in FIGS. 7 and 8, but utilizing a full quoin corner formed from over-mount corner units having yet a different configuration.
Figure 10:
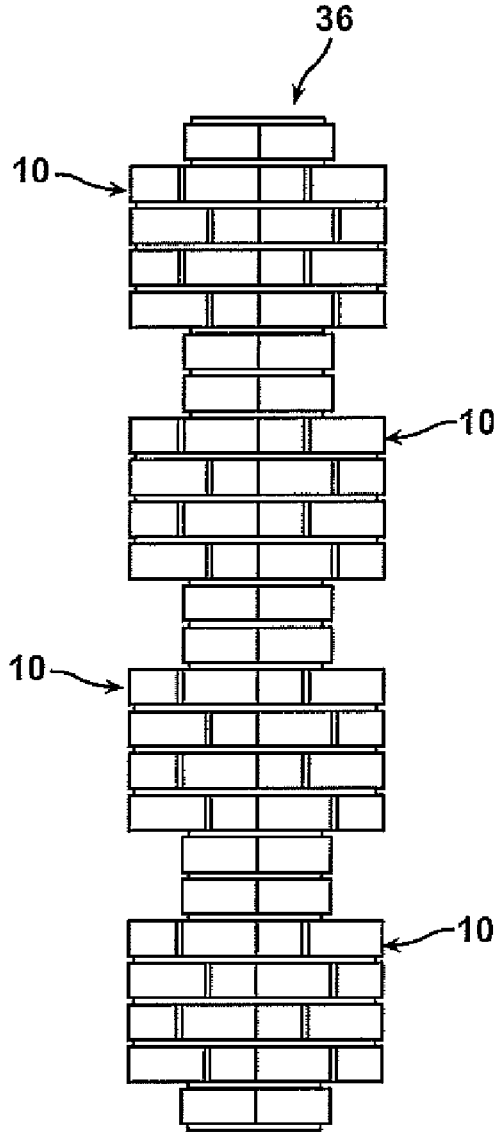
FIG. 10 is a full quoin corner similar to that shown in FIG. 6, but formed with over-mount corner units having a slightly different configuration.

As discussed above, the decorative exterior surface of the corner units 10 can be manufactured in a wide variety of patterns and configurations to simulate masonry or other types of surfaces for a residential home or commercial structure. Looking specifically at FIG. 8, a corner unit 10 is mounted on the walls of the building substructure 22 to provide a pattern of five courses of brick and a half wide face followed by a course of a single brick. The vertical mounting of the corner units 10 on the walls of the substructure 22 results in quoin 32 that has a substantially different appearance from the quoin 30 in FIG. 7. In the quoin 32, the corner units 10 are not be alternatively rotated, but stacked in the same orientation, one above the other. Similarly, the quoin 34 illustrated in FIG. 9 is formed with stacked corner units 10 having four single brick courses followed by four brick and a half courses. As can be appreciated by one of skill in the art, the vertical height of the corner units 10 can be established to correspond to the desired pattern for the completed quoin. In corner units containing larger simulated structures, such as the larger sized simulated bricks depicted in FIG. 9, the corner unit will typically have more than four standoffs 16, perhaps eight or ten standoffs 16, to provide a satisfactory attachment to the building substructure 20. In another embodiment, the corner units 10 in the quoin 36 are formed with a single brick course followed by four brick and a half courses and then another single brick course, as is shown in FIG. 10.

Figure 11:
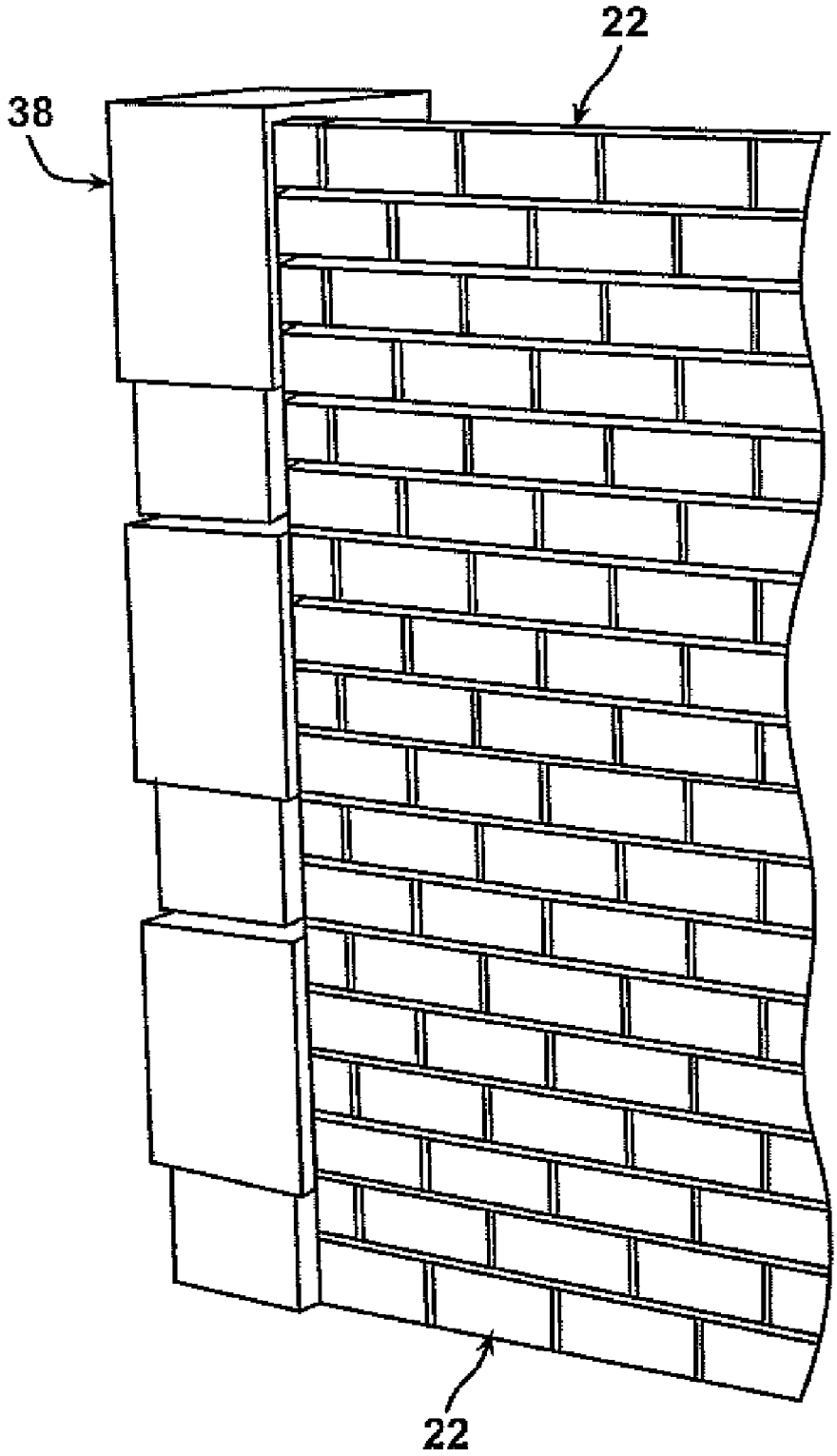
FIG. 11 is an elevational view of a portion of a building wall similar to that shown in FIG. 9, but utilizing a full quoin corner formed from over-mount corner units configured as stones.

In a further alternate embodiment illustrated in FIG. 11, the corner unit 10 may be manufactured to have an appearance of stone for the quoin 38. In the corner unit 10 depicted in FIG. 11, the alternating of a small stone with a large stone provides a joint between the two stones for the placement of one standoff 16. Additional standoffs 16 may be positioned to correspond to a flaw formed in the face of the stone(s) so that mortar would properly cover the fastener head when the corner unit is installed.

Alternatively, the quoins 30, 32, 34, 36, and 38 may be formed as a single, one-piece structure with numerous standoffs 16 to permit a proper mounting of the quoin corner unit on the building substructure 20. In other words, the quoin is formed to correspond to the height of the building to which it is to be attached. The single piece quoin corner mount appears identical to a quoin formed by individual corner mounts 10 and projects outwardly from the building substructure 20.

Such a one-piece quoin would be more difficult to handle than individual corner units 10 due to its larger size, and may require the use of a crane or other equipment to mount the quoin to the corner 13 of the building.

The invention of this application has been described above both generically and with regard to specific embodiments. Therefore, it is to be understood that a wide variety of alternatives known to those of skill in the art can be selected within the generic disclosure. The invention is not otherwise limited, except for the recitation of the claims set forth below.

Having thus described the invention, what is claimed is:

1. A corner unit for placement on an exterior corner of a building having a building substructure cooperative with simulated wall panels attached to exterior walls of said building to form a cover for said exterior walls, the corner unit comprising:

front, simulated surface portions joined at an intersection and defining a plurality of simulated masonry units extending outwardly from rear plate portions, a relief space formed between adjacent simulated masonry units and defining a simulated joint, said simulated surface portions mimicking an exterior surface of a building and providing a decorative appearance; and a plurality of standoffs projecting rearwardly of each of said simulated surface portions to engage said building substructure, each standoff aligned with one of said simulated joints on said simulated surface portion, each of said standoffs being formed with a passageway to permit passage of a fastener to secure said corner unit directly to said building substructure.

2. The corner unit of claim 1, further comprising a rear plate attached to said front, simulated surface, said plurality of standoffs projecting rearwardly of said rear plate.

3. The corner unit of claim 2, wherein said front surface portion and said rear plate are integrally formed.

4. The corner unit of claim 2, further comprising a polymer-based mortar between said simulated wall panels and said rear plate.

5. The corner unit of claim 2, further comprising a decorative member projecting outwardly from said front simulated surface.

6. An exterior wall of a building forming a corner at one end thereof with a generally orthogonally extending second exterior wall comprising:

a building substructure including a layer of exterior sheathing material;

a layer of wall panels having an exterior surface simulating an exterior surface of a building and attached to said sheathing material, said wall panels having a terminus end corresponding to said corner, said terminus end being located at a distance from said corner such that said sheathing material is exposed between said terminus end and said corner; and a quoin formed of at least one corner unit having a decorative exterior surface and a rear plate oriented in generally orthogonally extending faces, said decorative exterior surface defining a plurality of simulated masonry units extending outwardly from a rear plate portion, a relief space formed between adjacent simulated masonry units and defining a simulated joint, each orthogonally extending face of said rear plate including a plurality of standoffs projecting rearwardly from said rear plate and engaging said exposed sheathing material between said terminus end and said corner, each said face having a lateral width sufficiently large to overlap corresponding said terminus ends of said wall panels when attached to said exposed sheathing material; and each standoff aligned with one of said simulated joints on said decorative exterior surface.

7. The exterior wall of claim 6, wherein each of said standoffs are formed with a passageway to permit the passage of a fastener to connect said corner unit to said exposed sheathing material.

8. The exterior wall of claim 6, wherein said standoffs have a depth dimension measured rearwardly from said rear plate that is at least equal to a corresponding thickness dimension of said wall panels such that said rear plate will be positioned on top of the exterior surface of said wall panels when attached to said exposed sheathing material.

9. The exterior wall of claim 6, wherein said quoin is formed from a plurality of corner units oriented in a generally vertical configuration.

10. The exterior wall of claim 9, wherein said plurality of corner units are arranged in an alternating reverse orientation pattern such that said alternating corner units are rotated upside down with respect to adjacent corner units.

11. The exterior wall of claim 6, wherein said decorative exterior surface of each said corner unit is formed in a configuration defining simulated masonry units oriented in courses having joints between said masonry units.

12. The exterior wall of claim 6, wherein each said corner unit incorporates a plurality of courses, a first portion of said courses having more simulated bricks than a second portion of said courses.

13. A method of forming a decorative corner on an exterior wall of a building comprising:

mounting a quoin formed of at least one corner unit at a corner formed by two generally orthogonal external walls of a building, said external walls including wall panels attached to an exterior surface of sheathing material such that a terminus end of the wall panels is located a distance from said corner thereby exposing sheathing material, said at least one corner unit having front decorative simulated surfaces joined at an intersection and rear plates, each said rear plate including a plurality of standoffs projecting rearwardly from said rear plate to engage said sheathing material between said terminus end and said corner;

wherein said front decorative simulated surfaces define a plurality of simulated masonry units extending outwardly from said rear plate, said simulated surfaces mimicking an exterior surface of a building and providing a decorative appearance;

wherein a relief space is formed between adjacent simulated masonry units, said relief space defining a simulated joint; and wherein each of said standoffs is aligned with one of said simulated joints on said simulated surface.

14. The method of claim 13, wherein said mounting step includes:

driving a fastener through said front simulated surface and through said standoff into said exposed sheathing material; and covering said fastener by applying mortar to said simulated exterior surface over said fastener.

15. The method of claim 13, wherein mounting step includes:

attaching a plurality of corner units in a vertical configuration along said corner to form said quoin.

16. The method of claim 15, wherein said attaching step includes reversing the orientation of alternating said corner units.

17. The corner unit of claim 1, wherein said standoffs have a height at least equal to a thickness of said wall panels such that said simulated surface portions are positioned on top of said wall panels.

18. A corner unit for placement on an exterior corner of a building having a building substructure cooperative with simulated wall panels attached to exterior walls of said building to form a cover for said exterior walls, the corner unit comprising:

front, simulated surface portions joined at an intersection, said simulated surface portions mimicking an exterior surface of a building and providing a decorative appearance, said front simulated surface portions are formed into simulated masonry units having joints positioned between said masonry units; and a plurality of standoffs projecting rearwardly of each of said simulated surface portions to engage said building substructure, each of said standoffs being formed with a passageway to permit passage of a fastener to secure said corner unit directly to said building substructure, one or more of said standoffs being located in alignment with said joints.

19. The corner unit of claim 18, further comprising rear plates attached to said front, simulated surface portions, said plurality of standoffs projecting rearwardly of said rear plates.

* * * * *